US010843501B2

(12) United States Patent
Guillerey et al.

(10) Patent No.: US 10,843,501 B2
(45) Date of Patent: Nov. 24, 2020

(54) PRINTED SECURITY ELEMENT COMPRISING A RAINBOW FEATURE AND METHOD OF PRODUCING THE SAME

(71) Applicant: KBA-NOTASYS SA, Lausanne (CH)

(72) Inventors: Hervé Guillerey, La Conversions (CH); Johannes Schaede, Würzburg (DE); Hervé Tardy, Lutry (CH)

(73) Assignee: KBA-NOTASYS SA, Lausanne (CH)

( * ) Notice: Subject to any disclaimer, the term of this patent is extended or adjusted under 35 U.S.C. 154(b) by 0 days.

(21) Appl. No.: 16/637,505

(22) PCT Filed: Nov. 19, 2018

(86) PCT No.: PCT/EP2018/081747
§ 371 (c)(1),
(2) Date: Feb. 7, 2020

(87) PCT Pub. No.: WO2019/101683
PCT Pub. Date: May 31, 2019

(65) Prior Publication Data

US 2020/0238744 A1 Jul. 30, 2020

(30) Foreign Application Priority Data

Nov. 27, 2017 (EP) ..... 17203882

(51) Int. Cl.
*B42D 25/337* (2014.01)
*B42D 25/405* (2014.01)
*B41M 3/14* (2006.01)

(52) U.S. Cl.
CPC ..... *B42D 25/337* (2014.10); *B41M 3/14* (2013.01); *B42D 25/405* (2014.10)

(58) Field of Classification Search
CPC ..... B42D 25/337
(Continued)

(56) References Cited

U.S. PATENT DOCUMENTS 2,048,780 A * 7/1936 Clifford ..... B42D 25/29 283/94
6,101,939 A 8/2000 Giori et al.
2019/0160842 A1* 5/2019 Ueda ..... B42D 25/337

FOREIGN PATENT DOCUMENTS

DE 3130182 A1 * 2/1983 ..... B42D 25/337
DE 102008012421 B3 * 6/2009 ..... B42D 25/45
(Continued)

OTHER PUBLICATIONS

DE 10-2008-012421 Translation (Year: 2008).*
(Continued)

*Primary Examiner* — Kyle R Grabowski
(74) *Attorney, Agent, or Firm* — Nixon & Vanderhye P.C.

(57) ABSTRACT

There is described a printed security element (10; 10*; 10) comprising a rainbow feature (15; 15*; 15**) exhibiting, at least in part, a gradual transition from a first colour (C1) to a second colour (C2) distinct from the first colour (C1), wherein the rainbow feature (15; 15*; 15**) extends over a colour-gradient area (A) of the printed security element (10; 10*; 10**) where first and second printed patterns (P1, P2) are partly superimposed or juxtaposed, each of the first and second printed patterns (P1, P2) comprising a first, respectively second set of linear or curvilinear elements (20, 30; 20*, 30*), the first and second printed patterns (P1, P2) being printed in register one with the other by means of two distinct printing plates (PP1, PP2) so that the first and second sets of linear or curvilinear elements (20, 30; 20*, 30*) are partly superimposed or juxtaposed in the colour-gradient area (A) and thereby generate the rainbow feature (15; 15*; 15**), the first printed pattern (P1) exhibiting the first colour (C1) and being printed by means of a first printing plate (PP1) and the second printed pattern (P2) exhibiting the second colour (C2) and being printed by means of a second printing plate (PP2**), where at least the first or second printed
(Continued)

pattern (P1; P2) exhibits, in the colour-gradient area (A), a modulation of line width or line structure such as to cause, when superimposed or juxtaposed with the other printed pattern (P2; P1), a gradual transition from the first colour (C1) to the second colour (C2), wherein, in the colour-gradient area (A), the second printed pattern (P2) is printed on top of the first printed pattern (P1) and wherein the second colour (C2) is darker than the first colour (C1). Also described is a method of producing the aforementioned printed security element.

15 Claims, 10 Drawing Sheets

(58) Field of Classification Search
USPC ..... 283/114
See application file for complete search history.

(56) References Cited

FOREIGN PATENT DOCUMENTS

| | | | | | |
|---|---|---|---|---|---|
| EP | 1 053 887 | | | 11/2000 | |
| EP | 1 792 743 | | | 6/2007 | |
| JP | 2-283486 | | | 11/1990 | |
| JP | 2017013368 | A | * | 1/2017 | |
| RU | 2 143 342 | | | 12/1999 | |
| RU | 2 143 344 | | | 12/1999 | |
| RU | 2143342 | C1 | * | 12/1999 | ..... B41F 11/02 |
| WO | 2007/042919 | | | 4/2007 | |
| WO | 2007/105059 | | | 9/2007 | |
| WO | 2007/105061 | | | 9/2007 | |
| WO | WO-2007105059 | A1 | * | 9/2007 | ..... B41F 33/0036 |
| WO | 2008/099330 | | | 8/2008 | |
| WO | 2012/049610 | | | 4/2012 | |
| WO | 2013/001009 | | | 1/2013 | |
| WO | 2013/001010 | | | 1/2013 | |
| WO | 2013/001518 | | | 1/2013 | |
| WO | 2014/056711 | | | 4/2014 | |
| WO | 2016/042482 | | | 3/2016 | |

OTHER PUBLICATIONS

RU 2,143,342 Translation (Year: 1936).*
International Search Report and Written Opinion of the ISA for PCT/EP2018/081747, dated Feb. 15, 2019, 16 pages.

* cited by examiner

PRINTED SECURITY ELEMENT COMPRISING A RAINBOW FEATURE AND METHOD OF PRODUCING THE SAME

This application is the U.S. national phase of International Application No. PCT/EP2018/081747 filed 19 Nov. 2018, which designated the U.S. and claims priority to EP Patent Application No. 17203882.0 filed 27 Nov. 2017, the entire contents of each of which are hereby incorporated by reference.

TECHNICAL FIELD

The present invention generally relates to a printed security element comprising a rainbow feature exhibiting, at least in part, a gradual transition from a first colour to a second colour distinct from the first colour. The present invention also relates to a method of producing such a printed security element.

BACKGROUND OF THE INVENTION

Rainbow printing (or "iris printing") is known as such in the art.

For example, EP 1 792 743 A1 discloses a method for carrying out direct or indirect Orlov printing, comprising the steps of inking up areas of an assembled printing plate of a plate cylinder with multicolored inks to form a color interposition zone between original ink areas.

One-dimensional rainbow printing where two inks of different colours are mixed along a single axial direction, transversely to the path of the substrate material being printed is commonly used in the art of security printing, especially for the production of banknotes and other security documents. Printing equipment suitable for one-dimensional rainbow printing is known from instance from International (PCT) Publication No. WO 2014/056711 A1. Such equipment typically includes at least one printing plate that is inked by means of two inking units (as for instance shown in FIG. 2 of WO 2014/056711 A1) supplying first and second inks to a common ink train where the two inks are mixed along the axial direction. To this end, so-called vibrator rollers are interposed between the relevant ink fountains and a common inking roller (or "distribution roller") where the two inks are mixed, the relevant vibrator rollers being cut along the axial direction at appropriate locations where the inks are to be transferred (as for instance shown in FIG. 3 of WO 2014/056711 A1). Mixing of the inks along the axial direction is achieved by oscillating the distribution roller along the axial direction, thereby leading to a gradual transition from one ink colour to the other along the axial direction.

Other examples of printing equipment suitable for carrying out one-dimensional rainbow printing are known from International (PCT) Publications Nos. WO 2007/042919 A2, WO 2007/105059 A1, WO 2007/105061 A1, WO 2012/049610 A1, WO 2013/001518 A1, WO 2013/001009 A1, WO 2013/001010 A2 and WO 2016/042482 A2.

Two-dimensional rainbow printing (or 2D-iris printing) is also known as such in the art, especially from International (PCT) Publication No. WO 2008/099330 A2. Two-dimensional rainbow printing according to WO 2008/099330 A2 requires the use of a dedicated inking system allowing ink to be distributed not only along the axial direction, but also along the circumferential direction. This dedicated inking system is rather complex and furthermore suffers from limitation in terms of the relevant dimensions of individual documents (especially the height thereof) that are printable by this technique (as discussed with reference to FIGS. 8 and 9 of WO 2008/099330 A2).

Two-dimensional rainbow printing is also achievable by means of printing equipment as for instance disclosed in European Patent Publication No. EP 1 053 887 A2 and Russian Patents Nos. RU 2 143 344 C1 and RU 2 143 342 C1 and Japanese Application No. JP H02 283486 A.

In all of the above instances, at least two inks of different colours are distributed along one or more directions and transferred to the same printing plate that carries the whole printing pattern to be printed on the substrate material. While this ensures absolute register between the two (or more) ink colours, this requires a specific printing equipment as discussed above, which printing equipment leads to inherent design restrictions as only certain types of printed security elements are achievable with such printing equipment.

There is therefore a need for a printed security element of the type comprising a rainbow feature, which is achievable without the aforementioned restrictions, as well as for a method of producing such printed security element, which can be carried out differently than with the aforementioned printing equipment and with greater flexibility.

SUMMARY OF THE INVENTION

A general aim of the invention is therefore to improve the known printed security elements of the type comprising a rainbow feature and methods of producing the same.

These aims are achieved thanks to the printed security element and method of producing the same that are defined in the claims.

There is accordingly provided a printed security element comprising a rainbow feature exhibiting, at least in part, a gradual transition from a first colour to a second colour distinct from the first colour, wherein the rainbow feature extends over a colour-gradient area of the printed security element where first and second printed patterns are partly superimposed or juxtaposed, each of the first and second printed patterns comprising a first, respectively second set of linear or curvilinear elements. The first and second printed patterns are printed in register one with the other by means of two distinct printing plates so that the first and second sets of linear or curvilinear elements are partly superimposed or juxtaposed in the colour-gradient area and thereby generate the rainbow feature, the first printed pattern exhibiting the first colour and being printed by means of a first printing plate and the second printed pattern exhibiting the second colour and being printed by means of a second printing plate. Furthermore, at least the first or second printed pattern exhibits, in the colour-gradient area, a modulation of line width or line structure such as to cause, when superimposed or juxtaposed with the other printed pattern, a gradual transition from the first colour to the second colour.

There is also provided a method of producing a printed security element comprising a rainbow feature exhibiting, at least in part, a gradual transition from a first colour to a second colour distinct from the first colour, the method comprising the steps of:

- providing a first printing plate having a first set of linear or curvilinear printing elements forming a first printing pattern to be inked with the first colour;
- providing a second printing plate having a second set of linear or curvilinear printing elements forming a second printing pattern to be inked with the second colour, which second printing pattern is provided onto the second printing plate in such a way as to be printable in register with the first printing pattern of the first printing plate;

inking the first printing plate with the first colour and the second printing plate with the second colour;

printing a substrate by means of the first and second printing plates so as to produce first and second printed patterns on the substrate corresponding respectively to the first and second printing patterns, wherein the first and second printed patterns are printed in register so that first and second sets of linear or curvilinear elements are partly superimposed or juxtaposed in a colour-gradient area of the printed security element and thereby generate the rainbow feature.

Furthermore, in accordance with this method, at least the first or second printed pattern exhibits, in the colour-gradient area, a modulation of line width or line structure such as to cause, when superimposed or juxtaposed with the other printed pattern, a gradual transition from the first colour to the second colour.

In accordance with an aspect of the invention, the modulation of the line width or line structure is preferably such that the gradual transition from the first colour to the second colour is present along at least two different directions.

In accordance with a further aspect of the invention, the first and second printed/printing patterns can advantageously be structured such as to create a sharp and non-gradual transition from the first colour to the second colour next to the rainbow feature.

Advantageously, both the first and second printed/printing patterns may exhibit a modulation of the line width or line structure in the colour-gradient area.

In the colour-gradient area, the second printed pattern is printed on top of the first printed pattern and the second colour is darker than the first colour.

Furthermore, the first and second sets of linear or curvilinear elements are linear or curvilinear elements having advantageously a line width that does not exceed 100 μm.

Likewise, a modulation amplitude of the line width or line structure preferably does not exceed 100 μm.

Further advantageous embodiments of the invention are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

The present invention will be described in connection with various embodiments of printed security elements.

Figure 1:
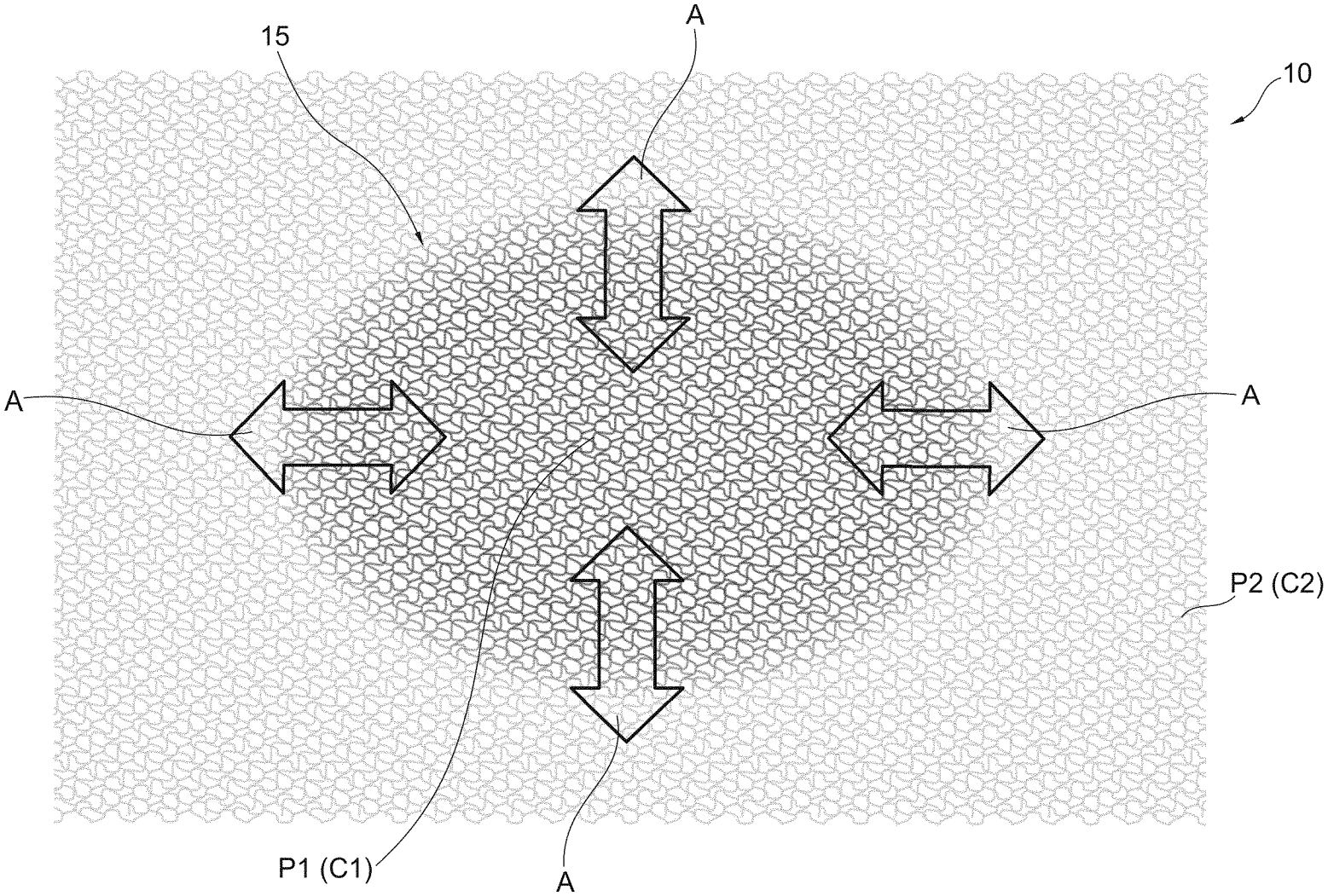
FIG. 1 is illustrative of a printed security element comprising a rainbow feature in accordance with a first embodiment of the invention, which rainbow feature exhibits a gradual transition in all directions from a first colour to a second colour distinct from the first colour.

FIG. 1 shows a first embodiment of a printed security element in accordance with the invention, which printed security element is designated generally by reference numeral 10. For the sake of illustration, the printed security element 10 consists of two partly superimposed printed patterns P1, P2 that are each printed in a given colour C1, respectively C2, which are distinguishable one from the other, for instance a red colour (C1) and yellow colour (C2).

The printed security element 10 comprises a rainbow feature 15 exhibiting a gradual transition from the first colour C1 to the second colour C2. In the illustrated example, the gradual transition from colour C1 to colour C2 is visible in all directions, the gradual transition extending here over an elliptically-shaped area (or "colour-gradient area") as generally identified by the four arrows A coinciding with the main axes of the depicted elliptical form.

Figure 1A:
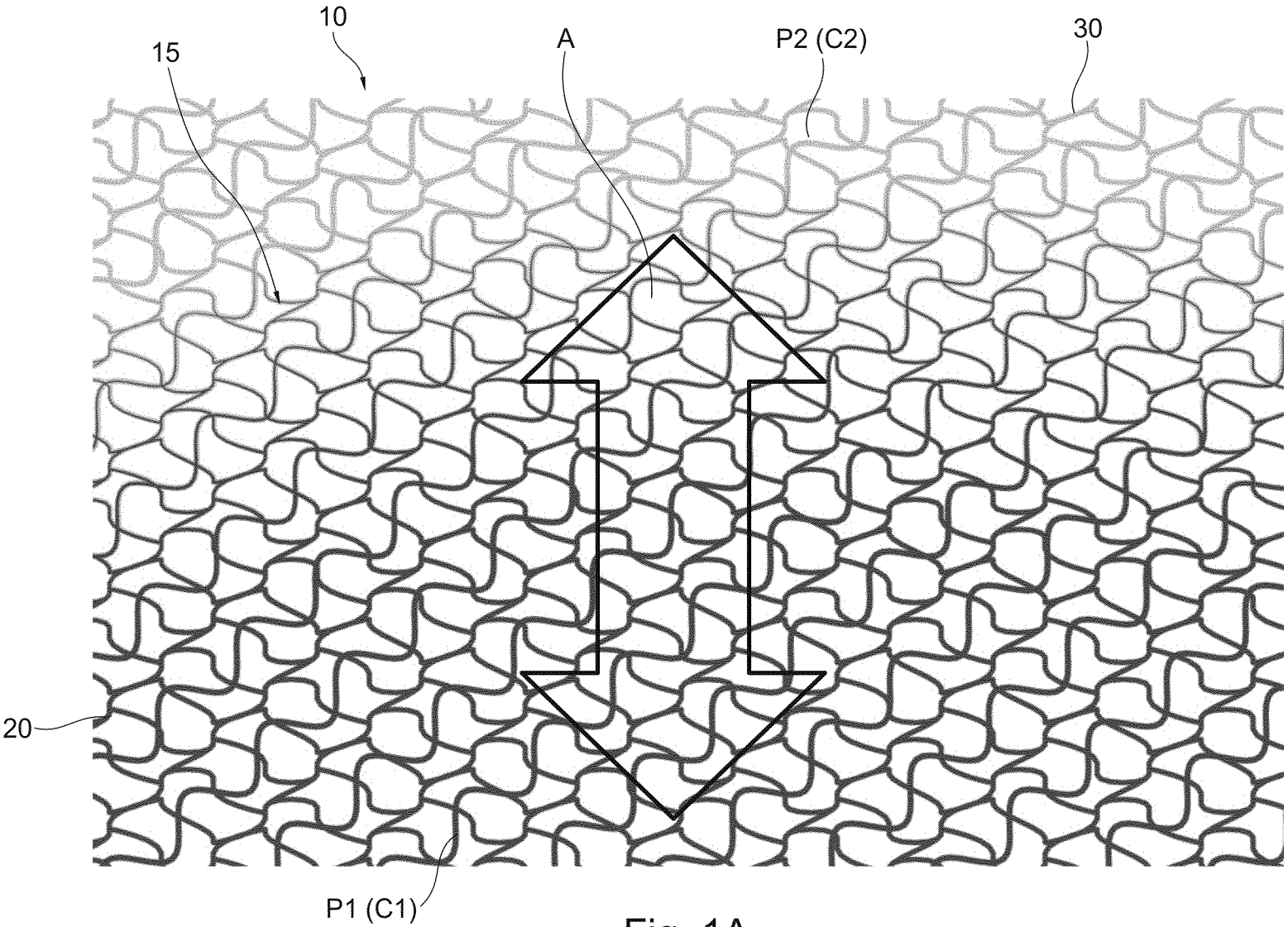
FIG. 1A is an enlarged view of a portion of the rainbow feature of the printed security element of FIG. 1, showing a superimposition of first and second printed patterns.

FIG. 1A is an enlarged view of a portion of the rainbow feature 15 of the printed security element 10 of FIG. 1, where the superimposition of the first and second printed patterns P1 and P2 is partly visible. In FIG. 1A, the gradual transition from the first colour C1 to the second colour C2 is visible from bottom to top, as also schematically identified by arrow A.

In the illustrated example, it shall be understood that the rainbow feature 15 is obtained as a result of superimposing the first and second printed patterns P1, P2, namely by printing both patterns in register one with the other so as to partly overlap. Each printed pattern P1, P2 comprises a first, respectively second set of linear or curvilinear elements 20, 30, which linear or curvilinear elements 20, 30 could basically exhibit any desired shape. Preferably, these linear or curvilinear elements 20, 30 have a line width that does not exceed 100 μm.

Figure 1B:
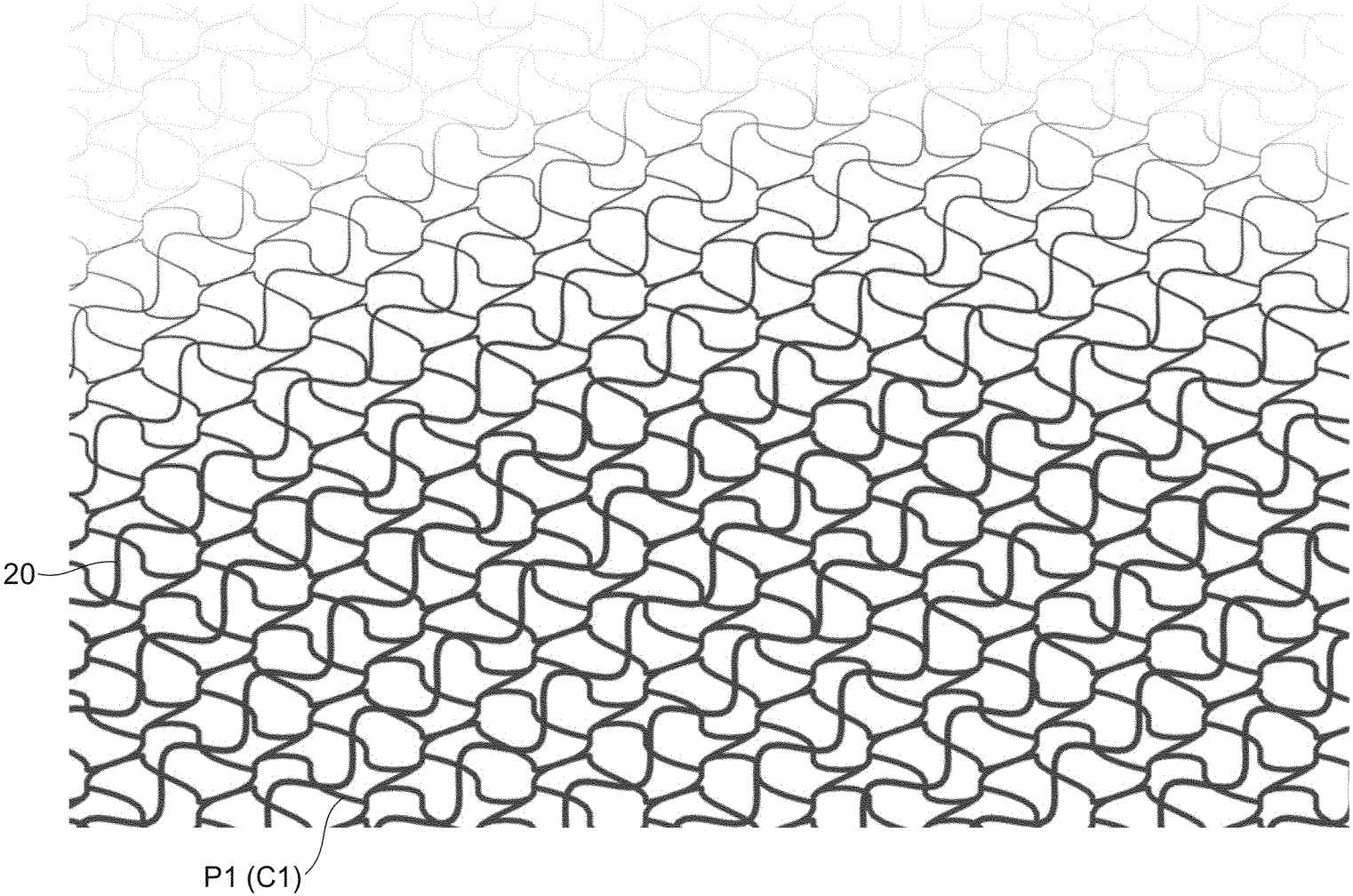
FIG. 1B is an enlarged view of the same portion as depicted in FIG. 1A where only the first printed pattern is shown.
Figure 1C:
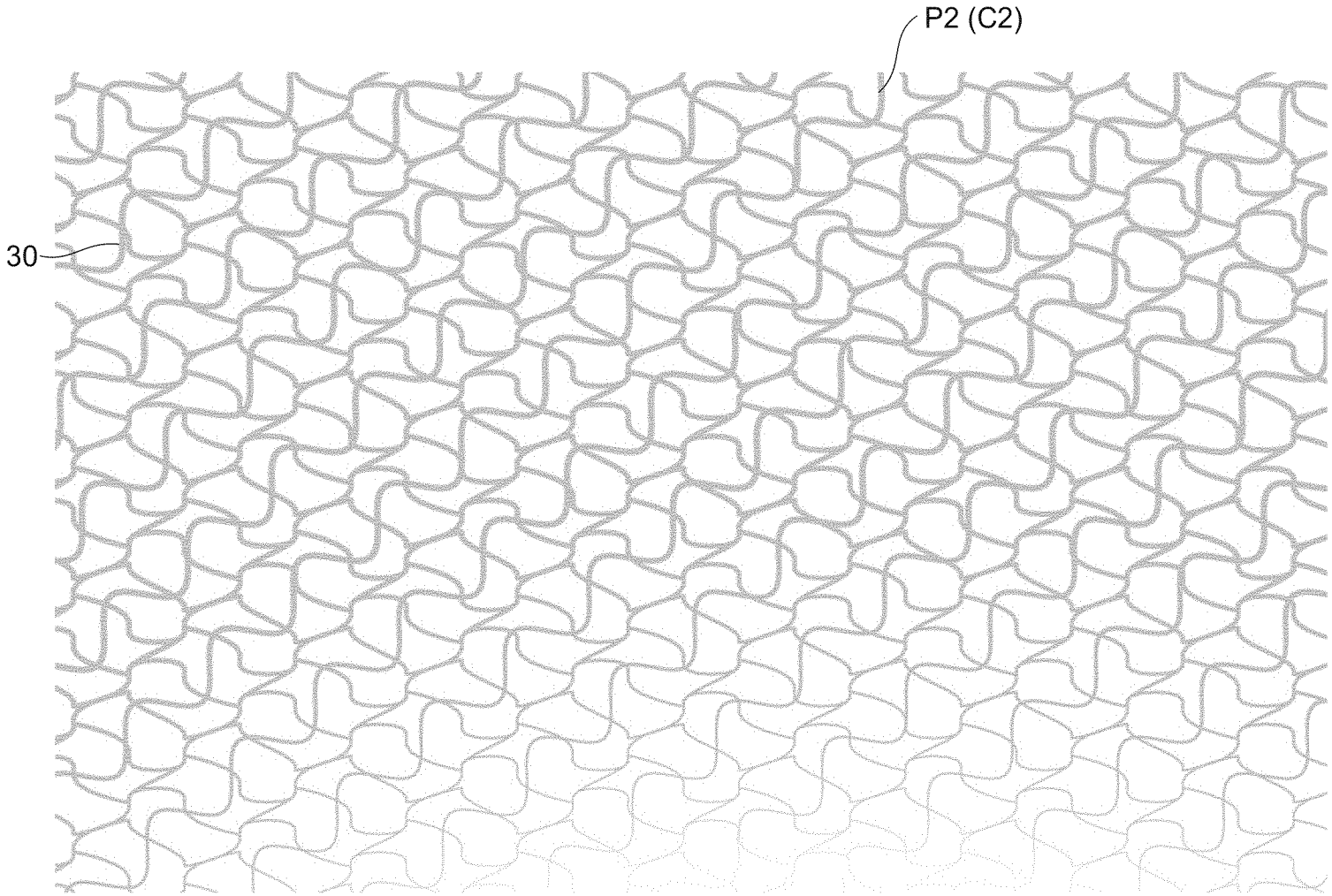
FIG. 1C is an enlarged view of the same portion as depicted in FIG. 1A where only the second printed pattern is shown.

FIG. 1B is an enlarged view of the same portion as depicted in FIG. 1A where only the first printed pattern P1 in the first colour C1 is shown. It may be noted that the first set of linear or curvilinear elements 20 that is constitutive of the first printed pattern P1 exhibits a modulation of line width, with a thicker line width being visible at the bottom of FIG. 1B compared to the upper part of FIG. 1B. FIG. 1C is an enlarged view of the same portion as depicted in FIG. 1A where only the second printed pattern P2 in the second colour C2 is shown. The second set of linear or curvilinear elements 30 that is constitutive of the second printed pattern P2 likewise exhibits a modulation of line width, however with a thicker line width being visible on the upper part of FIG. 1C compared to the lower part of FIG. 1C. In other words, in this first embodiment, both the first and second printed patterns P1, P2 each exhibit, in the relevant colour-gradient area A, a modulation of line width. When superimposed one with the other, a gradual transition from the first colour C1 to the second colour C2 is thus produced as shown in FIG. 1A. Preferably, the modulation amplitude of the line width of elements 20, 30 does not exceed 100 μm.

While the first embodiment shows that both the first and second printed patterns P1, P2 exhibit a modulation of line width, only one of the first and second printed patterns P1, P2 could exhibit such modulation. The gradual transition from the first colour C1 to the second colour C2 may furthermore be achieved by modulating the line structure, rather than merely the line width.

Figure 2:
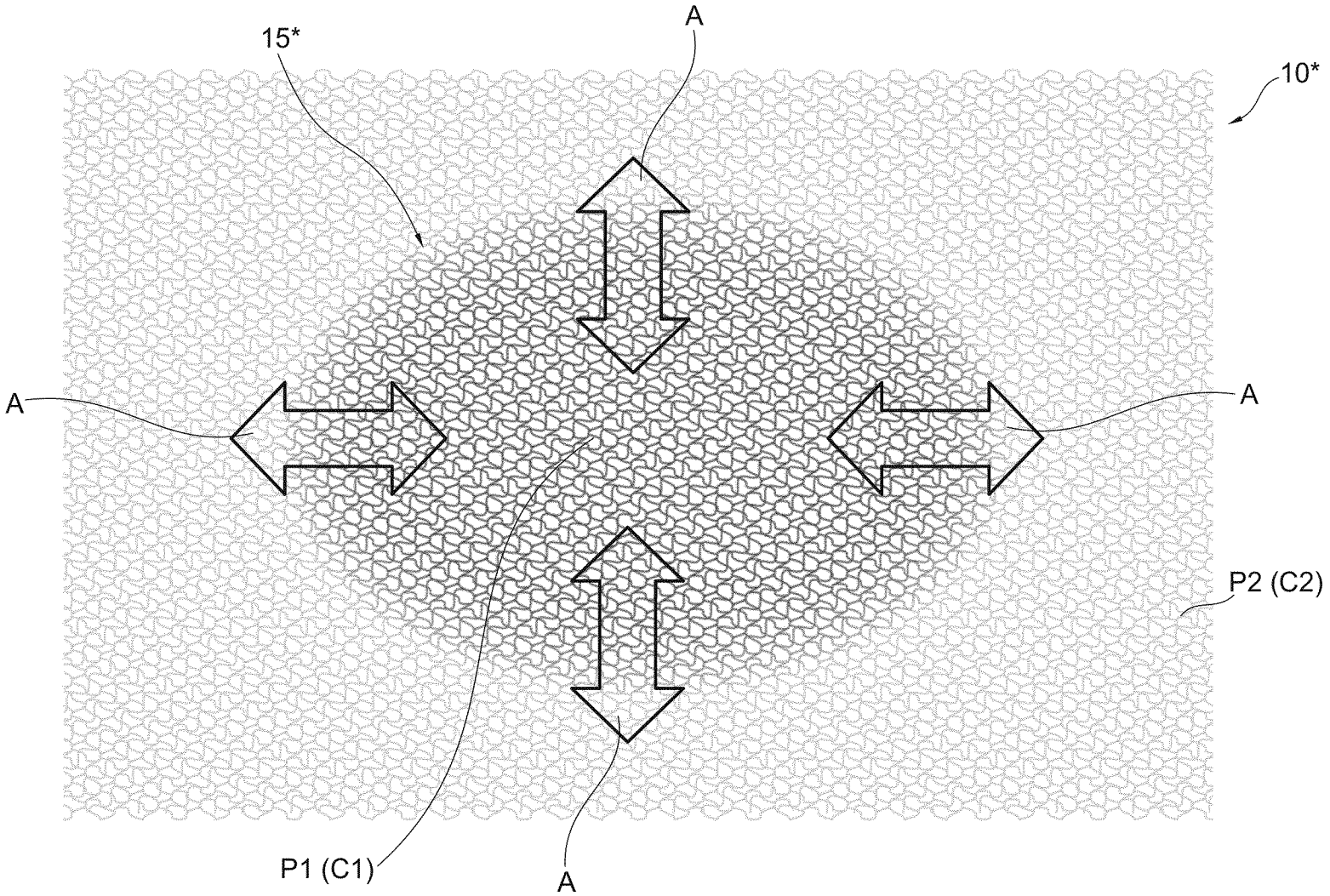
FIG. 2 is illustrative of a printed security element comprising a rainbow feature in accordance with a second embodiment of the invention, which rainbow feature likewise exhibits a gradual transition in all directions from a first colour to a second colour distinct from the first colour.

FIG. 2 shows a second embodiment of a printed security element in accordance with the invention, which printed security element is designated generally by reference numeral 10* in this other embodiment. For the sake of illustration, the printed security element 10* consists of two partly superimposed printed patterns P1, P2 that are each printed in a given colour C1, respectively C2, which are distinguishable one from the other. By way of illustration, these colours could likewise be a red colour (C1) and yellow colour (C2).

The printed security element 10* comprises—much like the printed security element 10 depicted in FIG. 1—a rainbow feature 15* exhibiting a gradual transition from the first colour C1 to the second colour C2. In the illustrated example, the gradual transition from colour C1 to colour C2 is once again visible in all directions and extends over an elliptically-shaped colour-gradient area A.

Figure 2A:
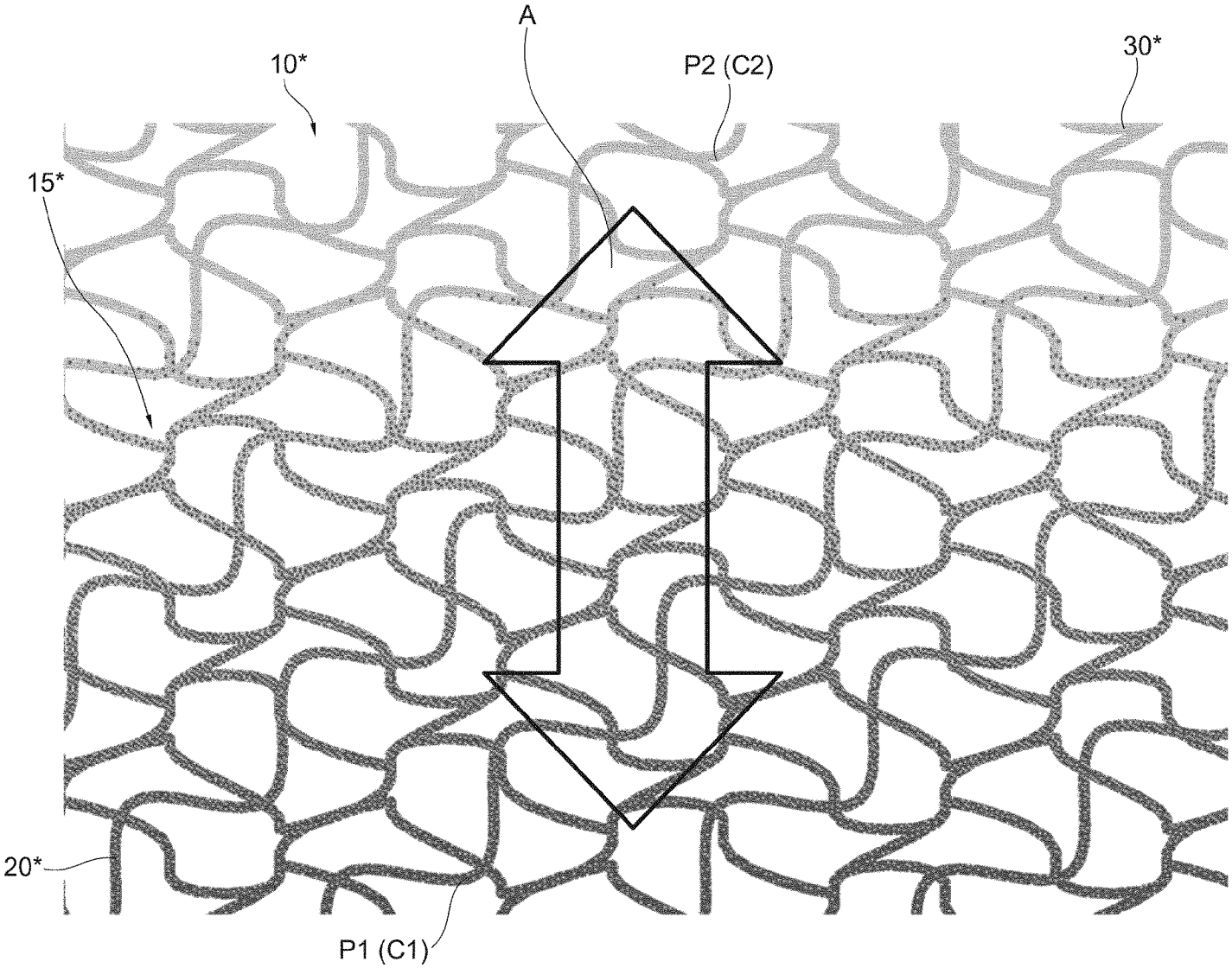
FIG. 2A is an enlarged view of a portion of the rainbow feature of the printed security element of FIG. 2, showing a superimposition of first and second printed patterns.

FIG. 2A is an enlarged view of a portion of the rainbow feature 15* of the printed security element 10* of FIG. 2, where the superimposition of the first and second printed patterns P1 and P2 is partly visible. In FIG. 2A, the gradual transition from the first colour C1 to the second colour C2 is likewise visible from bottom to top, as also schematically identified by arrow A.

In the illustrated example, it shall be understood that the rainbow feature 15* is once again obtained as a result of superimposing the first and second printed patterns P1, P2, namely by printing both patterns in register one with the other so as to partly overlap. Each printed pattern P1, P2 comprises a first, respectively second set of linear or curvilinear elements 20*, 30*, which linear or curvilinear elements 20*, 30* have basically the same shape as in the first embodiment. Elements 20*, 30* could however exhibit any desired shape.

Figure 2B:
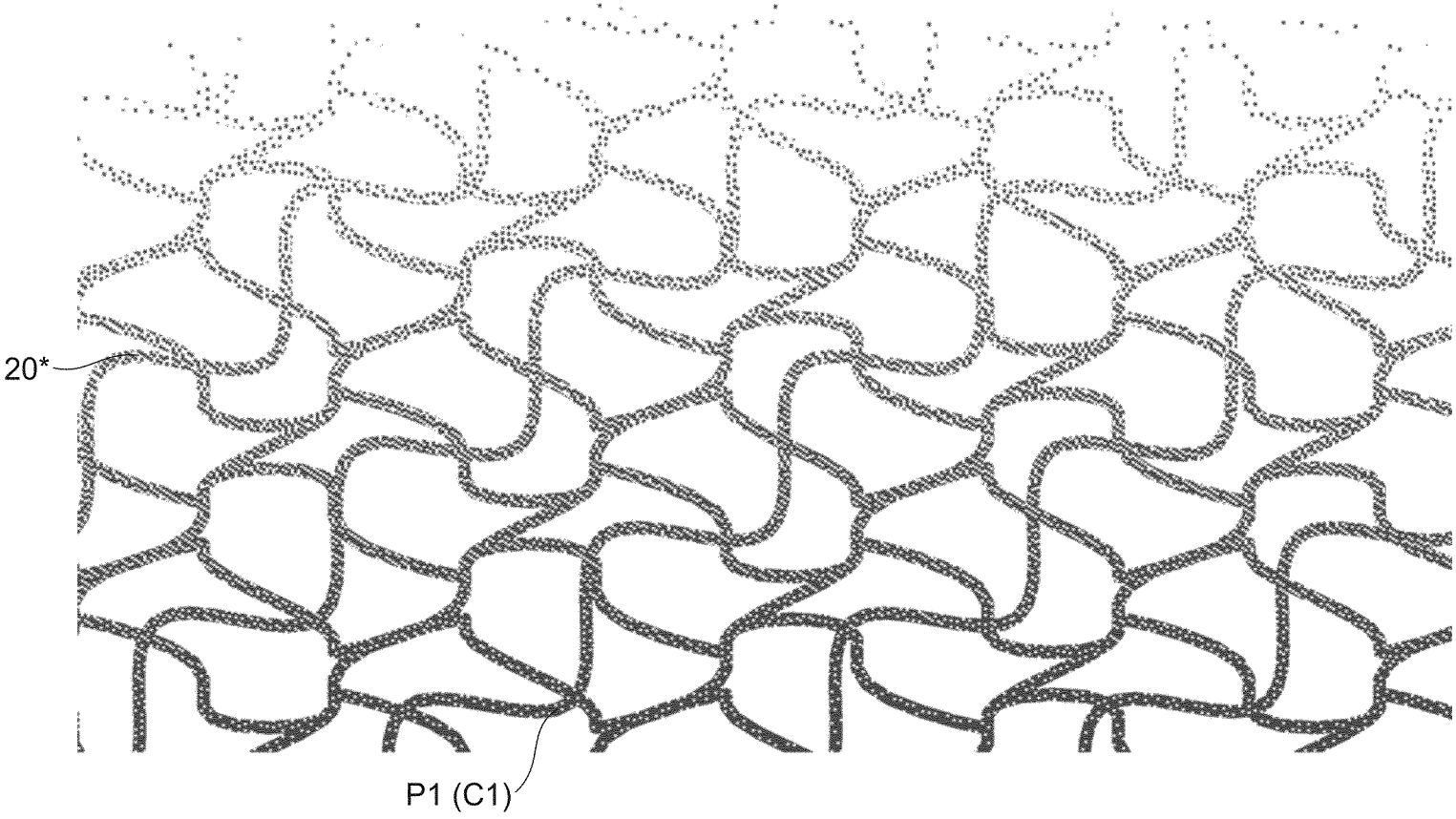
FIG. 2B is an enlarged view of the same portion as depicted in FIG. 2A where only the first printed pattern is shown.
Figure 2C:
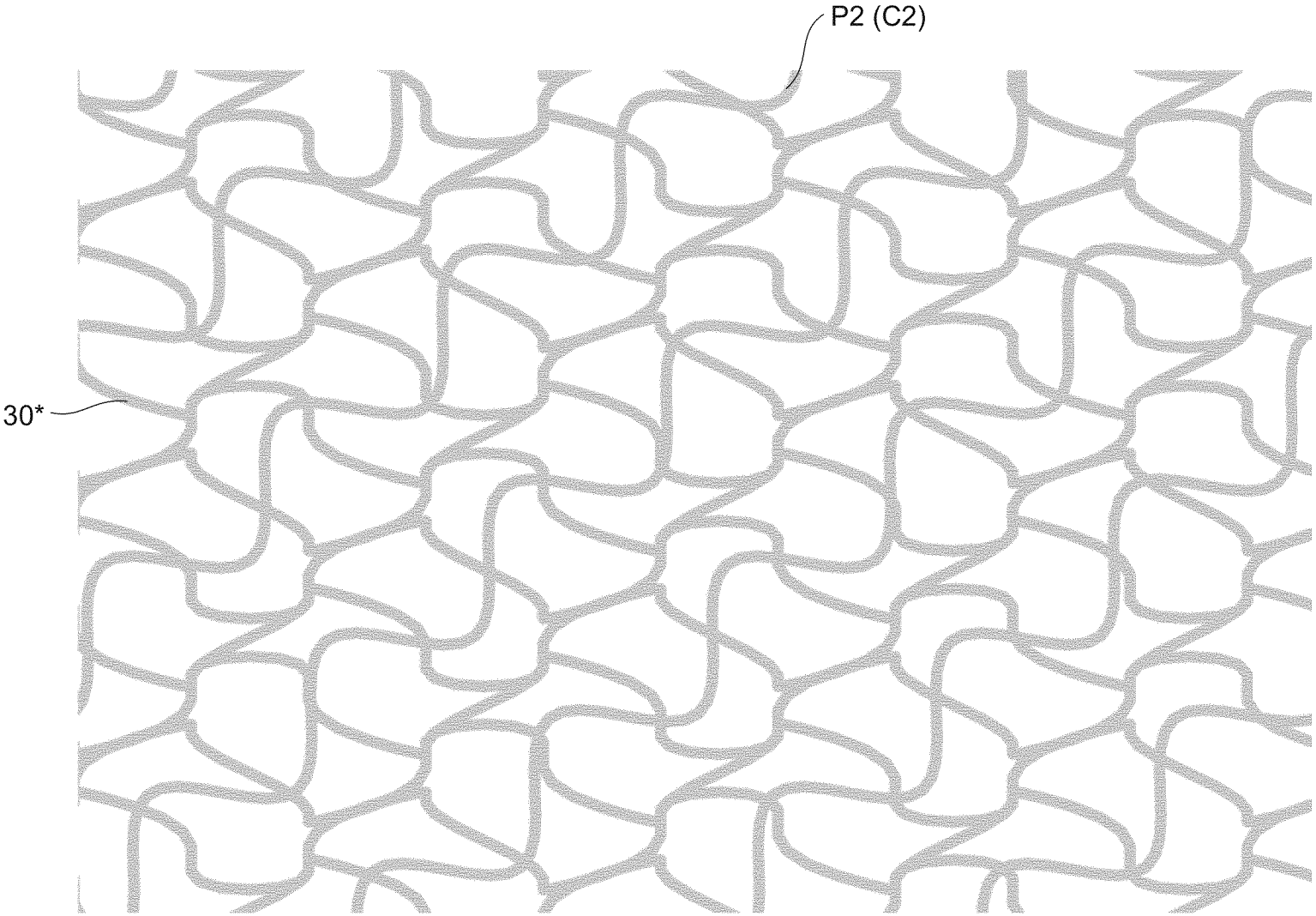
FIG. 2C is an enlarged view of the same portion as depicted in FIG. 2A where only the second printed pattern is shown.

FIG. 2B is an enlarged view of the same portion as depicted in FIG. 2A where only the first printed pattern P1 in the first colour C1 is shown. It may be noted that the first set of linear or curvilinear elements 20* that is constitutive of the first printed pattern P1 exhibits a modulation of line structure, rather than line width as in the first embodiment. In contrast to the first embodiment, the line width does not get thinner from bottom to top in FIG. 2B, but the line structure gets less dense as one moves up in FIG. 2B. This basically achieves the same objective as in FIG. 1B, however in a different manner. FIG. 2C is an enlarged view of the same portion as depicted in FIG. 2A where only the second printed pattern P2 in the second colour C2 is shown. In contrast to the first embodiment, the second set of linear or curvilinear elements 30* that is constitutive of the second printed pattern P2 does not exhibit any modulation of line width or line structure. In other words, in this second embodiment, only the first printed pattern P1 exhibits, in the relevant colour-gradient area A, a modulation of line structure. When superimposed one with the other, a gradual transition from the first colour C1 to the second colour C2 is however also produced as shown in FIG. 2A.

The linear or curvilinear elements 20*, 30* likewise preferably have a line width that does not exceed 100 μm. Similarly, the modulation amplitude of the line structure of elements 20* does not exceed 100 μm.

Figure 3:
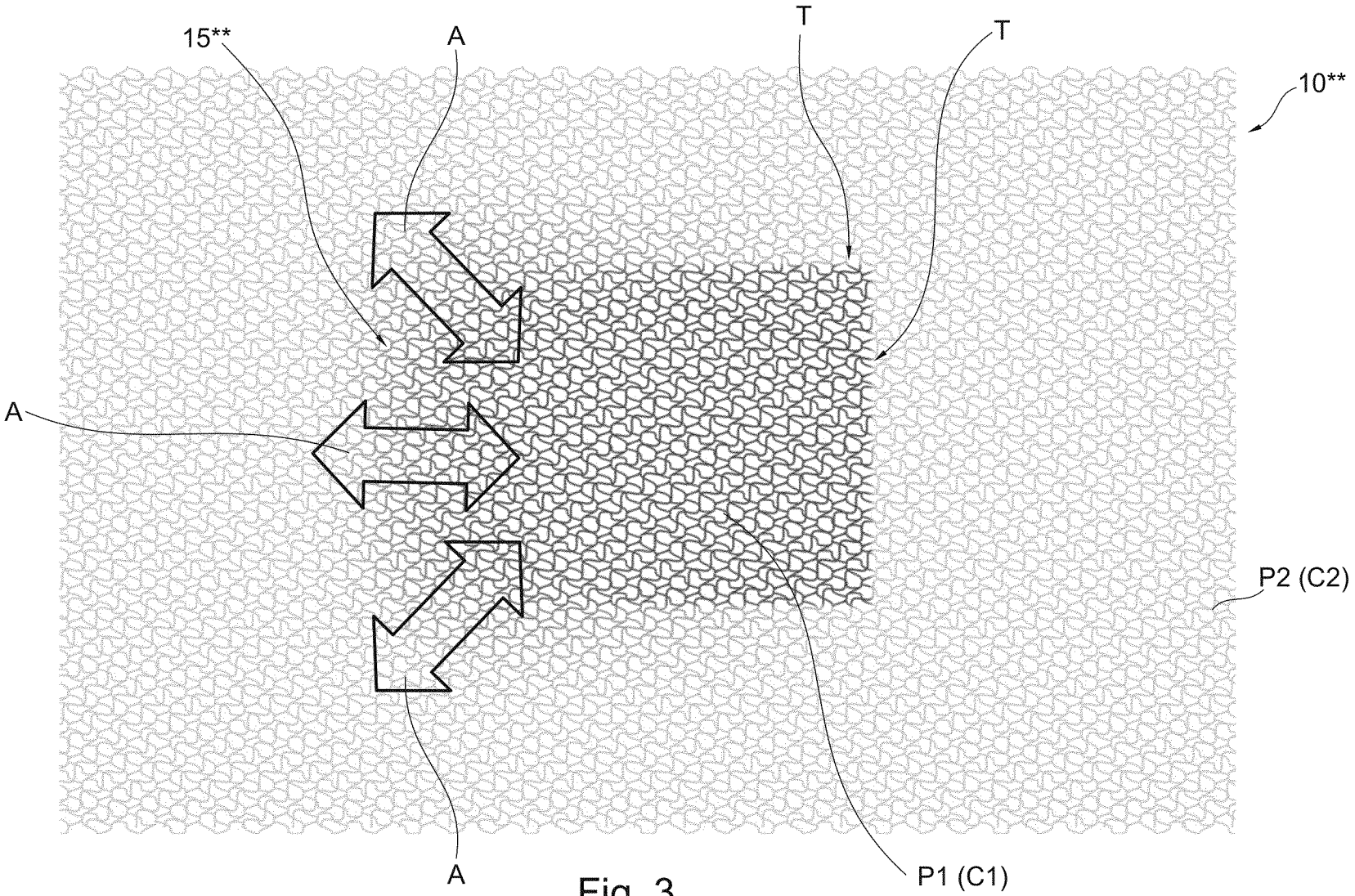
FIG. 3 is illustrative of a printed security element comprising a rainbow feature in accordance with a third embodiment of the invention, which rainbow feature exhibits a gradual transition in some directions from a first colour to a second colour distinct from the first colour, next to a sharp and non-gradual transition from the first colour to the second colour.

FIG. 3 shows a third embodiment of a printed security element in accordance with the invention, which printed security element is designated generally by reference numeral 10 in this other embodiment. For the sake of illustration, the printed security element 10** once again consists of two partly-superimposed printed patterns P1, P2 that are each printed in a given colour C1 (such as red colour), respectively C2 (such as yellow colour), which two colours C1, C2** are distinguishable one from the other.

The printed security element 10 comprises—much like the printed security elements 10 and 10* depicted in FIGS. 1 and 2—a rainbow feature 15** exhibiting a gradual transition from the first colour C1 to the second colour C2. In the illustrated example, the gradual transition from colour C1 to colour C2 is once again visible in all directions, but extends over a colour-gradient area A that differs in shape from the colour-gradient areas A shown in FIGS. 1 and 2. More precisely, the gradual transition is only visible on a left-hand side of the first printed pattern P1 illustrated in FIG. 3. In contrast to the previous embodiments, the first and second printed patterns P1, P2 are structured such as to create a sharp and non-gradual transition T from the first colour C1 to the second colour C2 next to the rainbow feature 15**, which transition T is visible on a right-hand side of the first printed pattern P1 illustrated in FIG. 3**.

While this is not specifically illustrated, it shall be understood that the rainbow feature 15 is obtained by partly superimposing the first and second printed patterns P1, P2, each comprising a first, respectively second set of linear or curvilinear elements. One of or both of the first and second printed patterns P1, P2 could exhibit, in the colour-gradient area A, a modulation of line width (like in the first embodiment) or line structure (like in the second embodiment) such as to cause, when superimposed one with the other, a gradual transition from the first colour C1 to the second colour C2**.

All of the aforementioned embodiments are based on a partial superimposition of the first and second printed patterns P1, P2, but it should be appreciated that a similar result could be achieved by partly juxtaposing the first and second printed patterns P1, P2 in the colour-gradient area A.

According to the invention, which consideration applies to all of the aforementioned embodiments, the first and second printed patterns P1, P2 are printed in register one with the other by means of two distinct printing plates so that the first and second set of linear or curvilinear elements are partly superimposed (or alternatively juxtaposed) in the colour-gradient area A and thereby generate the rainbow feature, the first printed pattern P1 exhibiting the first colour C1 and being printed by means of a first printing plate and the second printed pattern P2 exhibiting the second colour C2 and being printed by means of a second printing plate.

In that respect, the present invention also relates to a method of producing a printed security element (such as the printed security element 10, 10*, 10 of FIG. 1, 2 or 3) comprising a rainbow feature exhibiting, at least in part, a gradual transition from the first colour C1 to the second colour C2**. This method comprises the steps of:

providing a first printing plate having a first set of linear or curvilinear printing elements forming a first printing pattern to be inked with the first colour C1;

providing a second printing plate having a second set of linear or curvilinear printing elements forming a second printing pattern to be inked with the second colour C2, which second printing pattern is provided on the second printing plate in such a way as to be printable in register with the first printing pattern of the first printing plate;

inking the first printing plate with the first colour C1 and the second printing plate with the second colour C2; and printing a substrate by means of the first and second printing plates so as to produce the first and second printed patterns P1, P2 on the substrate corresponding respectively to the first and second printing patterns, which first and second printed patterns P1, P2 are printed in register so that first and second sets of linear or curvilinear elements thereof are partly superimposed or juxtaposed in the colour-gradient area A of the printed security element and thereby generate the rainbow feature.

In accordance with the method of the invention, at least the first or second printed pattern P1, resp. P2, exhibits, in the colour-gradient area A, a modulation of line width or line structure such as to cause, when superimposed or juxtaposed with the other printed pattern P2, resp. P1, a gradual transition from the first colour C1 to the second colour C2, as already described above.

The second printed pattern P2 is printed on top of the first printed pattern P1 and the second colour C2 is selected to be darker than the first colour C1.

Figure 4:
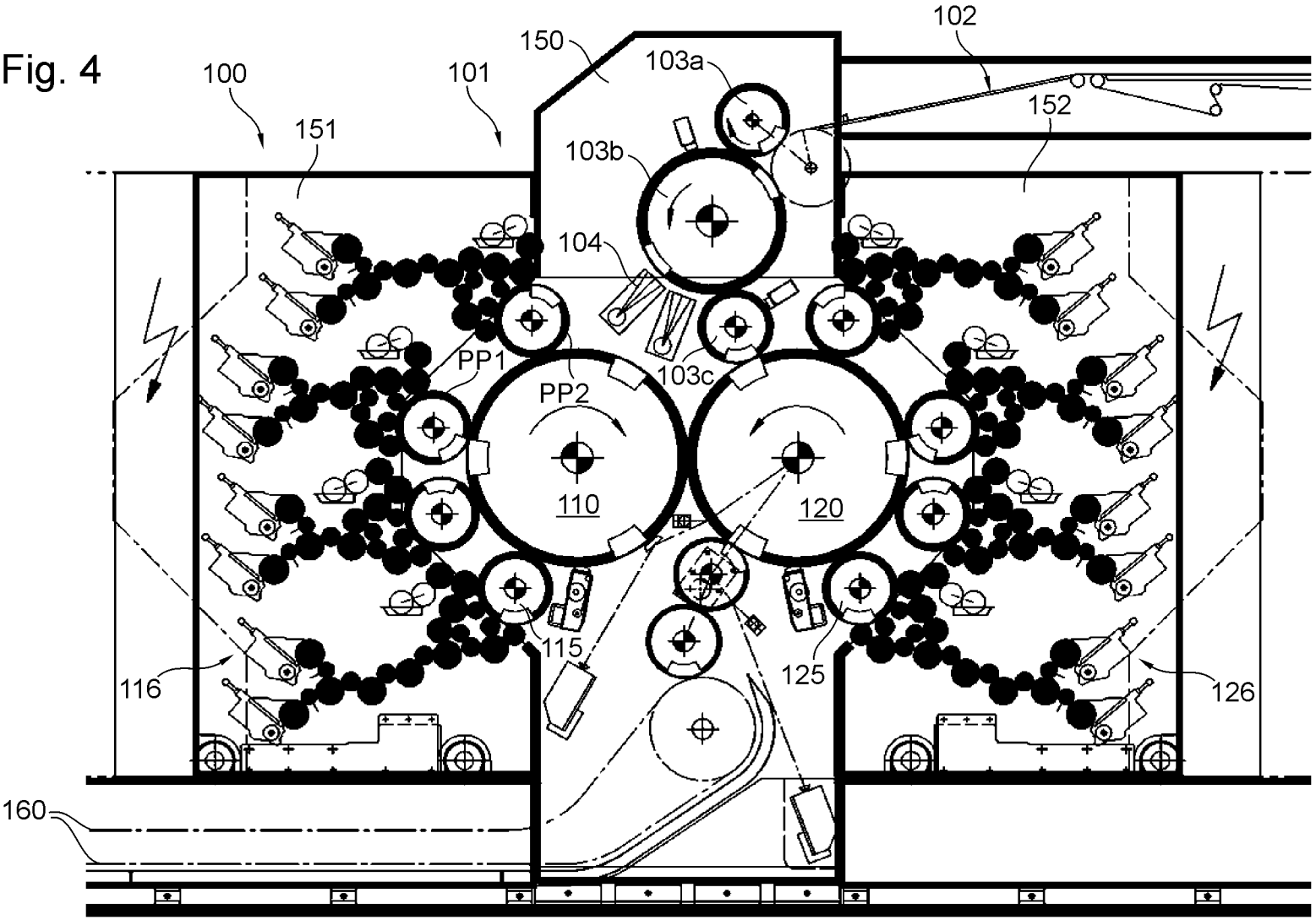
FIG. 4 is a schematic partial view of a printing press suitable for producing the printed security element of the invention.

The printed security element could be produced on any suitable printing equipment capable of achieving the desired register accuracy between the first and second printing patterns P1, P2. Such printing equipment is illustrated in FIG. 4, which shows a known sheet-fed offset printing press for simultaneous recto-verso printing of sheets of security documents as typically used for the production of banknotes, which printing press is designated globally by reference numeral 100. Such printing press is in particular marketed by the present Applicant under the product designation Super Simultan® IV. The basic configuration of this printing press is already described in International (PCT) Publication No. WO 2007/105059 A1.

A suitable printing press 100 comprises an offset printing group 101 with at least one blanket cylinder 110, 120 which receives and collects different ink patterns in their respective colours from at least two, e. g. four, plate cylinders 115 and 125, which are distributed around a portion of the circumference of the blanket cylinder 110, 120. These plate cylinders 115 and 125, which each carry a corresponding printing plate, are themselves inked by corresponding inking apparatuses 116 and 126, respectively. The blanket cylinder 110, 120 for printing works together with an impression cylinder 120, 110. In an advantageous form, e.g. like above Super Simultan® IV, the offset printing group 101 is specifically adapted to perform simultaneous recto-verso offset printing of the sheets and comprises, as is typical in the art, two blanket cylinders (or impression cylinders) 110, 120 rotating in the direction indicated by the arrows and between which the sheets are fed to receive multicolour impressions. In this example, blanket cylinders 110, 120 are three-segment cylinders which are supported between a pair of side frames designated by reference numeral 150. The blanket cylinders 110, 120 receive and collect different ink patterns in their respective colours from plate cylinders 115 and 125 (four on each side) which are distributed around a portion of the circumference of the blanket cylinders 110, 120. These plate cylinders 115 and 125, which each carry a corresponding printing plate, are themselves inked by corresponding inking apparatuses 116 and 126, respectively. The two groups of inking apparatuses 116, 126 are advantageously placed in two inking carriages 151, 152 that can be moved toward or away from the centrally-located plate cylinders 115, 125 and blanket cylinders 110, 120.

As is known in the art, each printing plate is wrapped around the corresponding plate cylinder 115, 125 and clamped at its leading end and trailing end by a suitable plate clamping system, which plate clamping system is located in a corresponding cylinder pit of the plate cylinder (see e.g. International (PCT) Publications Nos. WO 2013/001518 A1, WO 2013/001009 A1 and WO 2013/001010 A2).

Sheets are fed from a sheet feeding group 102 (including a feeder and feeder table) located next to the printing group 101 (on the right-hand side in FIG. 4) to a succession of transfer cylinders 103*a*, 103*b*, 103*c* (three cylinders in this example) placed upstream of the blanket cylinders 110, 120. While being transported by the transfer cylinder 103*b*, the sheets may optionally receive a first impression on one side of the sheets using an additional printing group (not illustrated) as described for instance in U.S. Pat. No. 6,101,939 and International (PCT) Publication No. WO 2007/042919 A2, transfer cylinder 103*b* fulfilling the additional function of impression cylinder in such a case. In case the sheets are printed by means of the optional additional printing group, the sheets are first dried by a drying or curing unit 104 before being transferred to the blanket cylinders 110, 120 for simultaneous recto-verso printing.

In the example of FIG. 4, the sheets are transferred onto the surface of blanket cylinder 120 where a leading edge of each sheet is held by appropriate gripper means located in cylinder pits between each segment of the blanket cylinder 120. Each sheet is thus transported by the blanket cylinder 120 to the printing nip between the blanket cylinders 110 and 120 where simultaneous recto-verso printing occurs. Once printed on both sides, the printed sheets are then transferred, as known in the art, to a chain gripper system 160 for delivery to a sheet delivery station (not shown) typically comprising multiple delivery pile units.

The printed security element of the present invention can be produced by providing the necessary first and second printing plates mentioned above, which printing plates are designated by references PP1 and PP2 in FIG. 4, on any of the relevant plate cylinders 115 or 125.

Various modifications and/or improvements may be made to the above-described embodiments. In particular, as already mentioned, while the disclosed embodiments have been described in connection with a partial superimposition of the first and second printed patterns P1, P2, a similar result can be achieved by a partial juxtaposition of first and second printed patterns.

Furthermore, use of more than two colours could be contemplated to generate even more complex rainbow features, and the claims should not be construed as being limited to the use of only two colours.

LIST OF REFERENCE NUMERALS USED THEREIN

10 printed security element (first embodiment of FIGS. 1 and 1A-1C)
10* printed security element (second embodiment of FIGS. 2 and 2A-2C)
10 printed security element (third embodiment of FIG. 3**)
15 rainbow feature of printed security element 10 exhibiting, at least in part, a gradual transition from a first colour C1 to a second colour C2 (first embodiment of FIGS. 1 and 1A-1C)
15* rainbow feature of printed security element 10* exhibiting, at least in part, a gradual transition from a first colour C1 to a second colour C2 (second embodiment of FIGS. 2 and 2A-2C)
15 rainbow feature of printed security element 10** exhibiting, at least in part, a gradual transition from a first colour C1 to a second colour C2 (third embodiment of FIG. 3**)
C1 first colour of the rainbow feature 15, 15*, 15**
C2 second colour of the rainbow feature 15, 15*, 15**
P1 first printed pattern forming part of the rainbow feature 15, 15*, 15**
P2 second printed pattern forming another part of the rainbow feature 15, 15*, 15**
A colour-gradient area A where the rainbow feature 15, 15*, 15 extends and where the first and second printed patterns P1, P2** are partly superimposed or juxtaposed
20 first set of linear or curvilinear elements forming part of the first pattern P1 of printed security element 10 (first embodiment of FIGS. 1 and 1A-1C)
30 second set of linear or curvilinear elements forming part of the second pattern P2 of printed security element 10 (first embodiment of FIGS. 1 and 1A-1C)
20* first set of linear or curvilinear elements forming part of the first pattern P1 of printed security element 10* (second embodiment of FIGS. 2 and 2A-2C)
30* second set of linear or curvilinear elements forming part of the second pattern P2 of printed security element 10* (second embodiment of FIGS. 2 and 2A-2C)
T sharp and non-gradual transition from the first colour C1 to the second colour C2, which contrasts with the gradual color transition of the rainbow feature 15* (third embodiment of FIG. 3**)
100 simultaneous recto-verso ("Simultan") offset printing press
101 printing group of printing press 100
102 sheet feeder group of printing press 100
103*a* sheet transfer cylinder (one-segment cylinder)
103*b* sheet transfer cylinder (two-segment cylinder)
103*c* sheet transfer cylinder (one-segment cylinder)
104 drying/curing unit
110 (first) blanket cylinder (three-segment cylinder)
115 (four) plate cylinders (one-segment cylinders)
116 (four) inking apparatuses supplying ink to plate cylinders 115
120 (second) blanket cylinder (three-segment cylinder)
125 (four) plate cylinders (one-segment cylinders)
126 (four) inking apparatuses supplying ink to plate cylinders 125
150 pair of side frames supporting blanket cylinders 110, 120
151 (first) mobile inking carriage supporting inking apparatuses 116
152 (second) mobile inking carriage supporting inking apparatuses 126
160 sheet transporting system (with spaced-apart gripper bars)
PP1 first printing plate bearing first printing pattern corresponding to the first printed pattern P1
PP2 second printing plate bearing second printing pattern corresponding to the second printed pattern P2

The invention claimed is:

1. A printed security element comprising:
a rainbow feature exhibiting, at least in part, a gradual transition from a first colour to a second colour distinct from the first colour,
wherein the rainbow feature extends over a colour-gradient area of the printed security elements, all of the portions of first and second printed patterns that are located within the colour-gradient area being superimposed with each other, each of the first and second printed patterns comprising respective first and second sets of linear or curvilinear elements, the first and second printed patterns being printed in register one with the other by way of two distinct printing plates so that the first and second sets of linear or curvilinear elements are at least partly superimposed in the colour-gradient area and thereby generate the rainbow feature, the first printed pattern exhibiting the first colour and being printed by way of a first printing plate and the second printed pattern exhibiting the second colour and being printed by way of a second printing plate,
wherein the colour-gradient area encompasses the entirety of at least one of the first and second printed patterns,
wherein at least one of the first and second sets of the linear or curvilinear elements exhibits, in the colour-gradient area, a modulation of line width or line structure that causes, when superimposed with the other set of linear or curvilinear elements, a gradual transition from the first colour to the second colour,
wherein, in the colour-gradient area, the second printed pattern is printed on top of the first printed pattern and wherein the second colour is darker than the first colour, and
wherein for each linear or curvilinear element with a line width modulation, an amplitude of the modulation is less than a maximum line width for said linear or curvilinear element.

2. The printed security element according to claim 1, wherein the modulation of the line width or line structure is such that the gradual transition from the first colour to the second colour is present along at least two different directions.

3. The printed security element according to claim 1, wherein the first and second printed patterns are structured to create a sharp and non-gradual transition from the first colour to the second colour next to the rainbow feature.

4. The printed security element according to claim 1, wherein both the first and second printed patterns exhibit a modulation of the line width or line structure in the colour-gradient area.

5. The printed security element according to claim 1, wherein the first and second sets of linear or curvilinear elements are linear or curvilinear elements having a line width that does not exceed 100 μm.

6. The printed security element according to claim 1, wherein the amplitude of the modulation of line width or line structure does not exceed 100 μm.

7. The printed security element according to claim 1, wherein the line width one of the first and second printed patterns modulates to become thinner or thicker while the line width of the other of the first and second printed patterns is consistent.

8. The printed security element according to claim 1, wherein the line width of one of the first and second printed patterns modulates to become thinner in a direction that the line width of the other of the first and second printed patterns modulates to become wider.

9. A method of producing a printed security element comprising a rainbow feature exhibiting, at least in part, a gradual transition from a first colour to a second colour distinct from the first colour, the method comprising the steps of:

providing a first printing plate having a first set of linear or curvilinear printing elements forming a first printing pattern to be inked with the first colour;

providing a second printing plate having a second set of linear or curvilinear printing elements forming a second printing pattern to be inked with the second colour, which second printing pattern is provided on the second printing plate in such a way as to be printable in register with the first printing pattern of the first printing plate;

inking the first printing plate with the first colour and the second printing plate with the second colour; and printing a substrate by way of the first and second printing plates so as to produce first and second printed patterns on the substrate corresponding respectively to the first and second printing patterns, wherein the first and second printed patterns are printed in register so that the first and second sets of linear or curvilinear elements are superimposed with each other in a colour-gradient area of the printed security element and thereby generate the rainbow feature, wherein at least one of the first and second sets of linear or curvilinear elements is entirely within the colour-gradient area, wherein at least one of the first and second sets of the linear or curvilinear elements exhibits, in the colour-gradient area, a modulation of line width or line structure that causes, when superimposed with the other set of linear or curvilinear elements, a gradual transition from the first colour to the second colour, wherein, in the colour-gradient area, the second printed pattern is printed on top of the first printed pattern and wherein the second colour is darker than the first colour, and wherein for each linear or curvilinear element with a line width modulation, an amplitude of the modulation is less than a maximum line width for said linear or curvilinear element.

10. The method according to claim 9, wherein the modulation of the line width or line structure is such that the gradual transition from the first colour to the second colour is present along at least two different directions.

11. The method according to claim 9, wherein the first and second printing patterns and resulting first and second printed patterns are structured to create a sharp and non-gradual transition from the first colour to the second colour next to the rainbow feature.

12. The method according to claim 9, wherein both the first and second printing patterns and resulting first and second printed patterns exhibit a modulation of the line width or line structure in the colour-gradient area.

13. The method according to claim 9, wherein the first and second sets of linear or curvilinear elements are linear or curvilinear elements having a line width that does not exceed 100 μm.

14. The method according to claim 9, wherein the amplitude of the modulation of line width or line structure does not exceed 100 μm.

15. The method according to claim 9, wherein printing the substrate by way of the first and second printing plates is performed by an offset printing group with at least one blanket cylinder which receives and collects the first and second printing patterns from two plate cylinders, which are distributed around a portion of the circumference of the same blanket cylinder.

* * * * *